US010982472B1

(12) United States Patent
Fazi

(10) Patent No.: US 10,982,472 B1
(45) Date of Patent: Apr. 20, 2021

(54) APPLIANCE LOCK ASSEMBLY

(71) Applicant: Dometic Sweden AB, Solna (SE)

(72) Inventor: Mark Raymond Fazi, Osceola, IN (US)

(73) Assignee: DOMETIC SWEDEN AB, Solna (SE)

( * ) Notice: Subject to any disclaimer, the term of this patent is extended or adjusted under 35 U.S.C. 154(b) by 414 days.

(21) Appl. No.: 15/804,414

(22) Filed: Nov. 6, 2017

Related U.S. Application Data

(60) Provisional application No. 62/418,322, filed on Nov. 7, 2016.

(51) Int. Cl.
*E05C 7/04* (2006.01)
*E05C 3/02* (2006.01)
(Continued)

(52) U.S. Cl.
CPC ..... *E05C 7/04* (2013.01); *E05B 1/0015* (2013.01); *E05B 15/0205* (2013.01); *E05C 3/004* (2013.01); *E05C 3/02* (2013.01); *E05C 5/00* (2013.01); *E05B 65/0042* (2013.01); *F25D 23/025* (2013.01); *F25D 2323/021* (2013.01)

(58) Field of Classification Search
CPC .. E05B 63/02; E05B 65/0014; E05B 65/0042; E05B 65/5253; E05B 65/5284; E05B 15/0205; E05B 1/0015; E05C 3/004; E05C 3/02; E05C 7/04; E05C 17/50; E05C 17/505; E05C 19/10; E05C 19/12; E05C 5/00; Y10T 292/0911; Y10T 292/0945; Y10T 292/0948; Y10T 292/0951; Y10T 292/34; Y10T 292/37; Y10S 292/71; F25D 23/025; F25D 2323/021
USPC ..... 292/95, 96, 99, 101, 288, 289, DIG. 71; 312/107.5, 215–222
See application file for complete search history.

(56) References Cited

U.S. PATENT DOCUMENTS 28,241 A * 5/1860 Richards ..... E05C 19/10 292/108
91,369 A * 6/1869 Sargent ..... E05B 65/46 292/95

(Continued)

FOREIGN PATENT DOCUMENTS

CN 103162500 A * 6/2013
CN 107700988 A * 2/2018

OTHER PUBLICATIONS

U.S. Patent and Trademark Office, U.S. Appl. No. 15/804,384 entitled "Shelf Lock Assembly" filed Nov. 6, 2017.

(Continued)

*Primary Examiner* — Christine M Mills
(74) *Attorney, Agent, or Firm* — Middleton Reutlinger

(57) ABSTRACT

An appliance lock assembly is provided which allows conversion of a residential or static structure-type appliance having at least one door or drawer to be utilized in a mobile structure, such as a recreational vehicle ("RV"), boat or other mobile environment wherein the at least one door or drawer should be locked to inhibit unintentional opening during mobile operations and scattering of contents from within the appliance. The lock assembly comprises a lock bar which is disposed between a handle and a front surface of an appliance door. The lock bar pivots between an unlocked position, and a locked position wherein the lock bar engages a striker.

13 Claims, 11 Drawing Sheets

(51) Int. Cl.

| | |
|---|---|
| ***E05C 3/00*** | (2006.01) |
| ***E05B 1/00*** | (2006.01) |
| ***E05C 5/00*** | (2006.01) |
| ***E05B 15/02*** | (2006.01) |
| *E05B 65/00* | (2006.01) |
| *F25D 23/02* | (2006.01) |

(56) References Cited

U.S. PATENT DOCUMENTS

| | | | | | |
|---|---|---|---|---|---|
| 95,146 | A * | 9/1869 | Sage | E05B 65/46 | 292/95 |
| 107,651 | A * | 9/1870 | Berbecker | E05B 65/46 | 292/95 |
| 108,778 | A * | 11/1870 | Gorman | E05C 3/046 | 292/241 |
| 132,862 | A * | 11/1872 | Sargent | E05B 65/46 | 292/95 |
| 178,885 | A * | 6/1876 | Taylor | E05C 19/10 | 292/106 |
| 234,000 | A * | 11/1880 | Dearborn | E05C 19/10 | 292/108 |
| 425,330 | A * | 4/1890 | Langson | E05B 65/46 | 292/95 |
| 815,589 | A * | 3/1906 | Johnson | E05B 65/46 | 292/95 |
| 3,383,130 | A * | 5/1968 | De Avila | E05B 13/002 | 292/92 |
| 3,966,158 | A | 6/1976 | Boundy | | |
| 4,133,433 | A | 1/1979 | Wolf | | |
| 4,154,419 | A | 5/1979 | Breidenbach | | |
| 4,324,379 | A | 4/1982 | Ovitz, III | | |
| 4,684,094 | A | 8/1987 | Everett | | |
| 5,022,621 | A | 6/1991 | Quest | | |
| 5,152,564 | A * | 10/1992 | Martineau | E05C 7/00 | 200/61.62 |
| 5,641,217 | A | 6/1997 | Caruso et al. | | |
| 5,704,662 | A * | 1/1998 | Kwiatkowski | E05B 17/2023 | 292/194 |
| 6,053,544 | A * | 4/2000 | Alvring | E05C 1/10 | 292/203 |
| D440,238 | S | 4/2001 | Alvring et al. | | |
| 6,296,285 | B1 | 10/2001 | Alvring et al. | | |
| 6,357,803 | B1 | 3/2002 | Lorek | | |
| 7,537,250 | B1 * | 5/2009 | Gustafson | E05B 65/0014 | 292/259 R |
| 7,798,542 | B2 * | 9/2010 | Frazier | E05C 7/04 | 292/258 |
| 7,871,113 | B2 * | 1/2011 | Watanabe | E05B 17/0025 | 292/241 |
| 8,104,800 | B2 | 1/2012 | Lorek | | |
| 8,157,336 | B2 * | 4/2012 | Hayase | A47F 3/005 | 312/222 |
| 8,313,128 | B2 * | 11/2012 | Belyea | E05B 13/00 | 292/258 |
| 8,556,359 | B1 * | 10/2013 | Gorgievski | F25D 23/028 | 312/218 |
| 8,575,430 | B2 | 11/2013 | Arrieta | | |
| 10,342,335 | B1 | 7/2019 | Fazi | | |
| 2004/0104581 | A1 | 6/2004 | Lorek et al. | | |
| 2008/0083242 | A1 | 4/2008 | Muller et al. | | |
| 2017/0362864 | A1 | 12/2017 | Fazi | | |

OTHER PUBLICATIONS

Restriction Requirement received in U.S. Appl. No. 15/804,384 dated Apr. 4, 2018.

Non-Final Office Action issued in U.S. Appl. No. 15/804,384 dated Jun. 13, 2018.

Final Office Action issued in U.S. Appl. No. 15/804,384 dated Oct. 24, 2018.

Notice of Allowance issued in U.S. Appl. No. 15/804,384 dated Feb. 19, 2019.

* cited by examiner

APPLIANCE LOCK ASSEMBLY

CLAIM TO PRIORITY

This non-provisional patent application claims priority to and benefit of, under 35 U.S.C. § 119(e), U.S. Provisional Patent Application Ser. No. 62/418,322, filed Nov. 7, 2016 and titled "Appliance Lock Assembly", all of which is incorporated by reference herein.

BACKGROUND

Field of the Invention

The present embodiments relate to an appliance lock assembly. More particularly, the present disclosure relates to an appliance lock assembly which may be utilized with existing hardware for converting a residential/static-type appliance to a mobile appliance.

Description of the Related Art

When using a mobile appliance such as a refrigerator, oven, shelves, or any such appliance, administrative regulations require that the appliance be locked when in a closed position to inhibit doors, drawers or other closure from opening and the contents of the appliance falling out during mobile operations. It is desirable therefore to provide such features on mobile appliances.

It is desirable to use home appliances in mobile applications due in part to larger size and more desirable aesthetic appearance. However, such home or stationary-type appliances generally do not utilize locking features on any of the doors of such appliance types. In normal use, there is little or no concern for appliance doors or drawers opening unexpectedly and contents flying out.

It would be desirable to utilize residential model appliances with mobile operations or settings and overcome issues related to lack of locking features in residential appliances.

It would further be desirable to require minimal effort for installation of any such locking features in combination with existing hardware on residential-type appliances.

It would further be desirable to limit the modifications necessary to an existing appliance in adding the lock to render the appliance usable for mobile configurations.

The information included in this Background section of the specification, including any references cited herein and any description or discussion thereof, is included for technical reference purposes only and is not to be regarded subject matter by which the scope of the invention is to be bound.

SUMMARY

The present application discloses one or more features recited in the appended claims and/or the following features which, alone or in any combination, may comprise patentable subject matter.

Present embodiments provide an appliance lock assembly which requires little modification to an existing appliance in order to provide the locking functionality required for mobile applications of the appliance. Further, the appliance lock assembly may be at least partially hidden behind appliance hardware for improved aesthetics.

According to some embodiments, an appliance lock assembly comprising an appliance housing having at least one opening, a first door and a second door extending across the opening and being pivotally connected to the housing at opposite sides, the doors being openable in directions away from one another, each of the doors having one of a first handle and a second handle which is connected to a front surface of the doors, a pivotable lock arm positioned between one of the first handle and the second handle, and the front surface of one of the doors, a striker disposed between the other of the first handle and the second handle, and the front surface of the other of the doors, wherein the lock arm is rotatable from a first unlocked position to a second locked position engaging the striker.

According to some optional embodiments, the lock arm may have a pivoting connection which is hidden by one of the first and second handles. The striker may be hidden by the other of the first and second handles. The lock arm may extend across a space between said first and second doors. The lock arm may have one of a receiver and a catch. The striker may have the other of the receiver and the catch. The receiver may be of a first preselected shape and the catch may be of a second preselected shape corresponding to the first preselected shape of the receiver.

According to some embodiments, an appliance lock assembly may comprise an appliance housing having at least one opening, a first door and a second door pivotally connected to the housing for accessing and closing the opening, the doors having a handle to grasp and move the doors, a first base disposed beneath one of the handles and a second base disposed beneath the other of the handles, a lock arm engaging one of the bases and configured to engage or disengage the other of the bases.

According to some optional embodiments, the arm may be pivotally connected to one of the bases and have one of a striker or a receiver. The other of the bases may have the other of the striker and the receiver. The arm may have a slot allowing the pivoting and a sliding motion. The lock arm may be disposed in one of the bases. The lock arm being U-shaped. The at least one of the bases may have first and second holes. The lock arm may be disposed in one hole of each of the bases. Each of the bases may have a slot to recess the lock arm. The appliance lock assembly may further comprise a first base and a second base. The appliance lock assembly may further comprise the lock arm extending through one of the bases and into the other of the bases.

All of the above outlined features are to be understood as exemplary only and many more features and objectives of an appliance lock assembly and may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the appliance lock assembly will now be described by way of examples. These embodiments are not to limit the scope of the claims as other embodiments of the appliance lock assembly will become apparent to one having ordinary skill in the art upon reading the instant description. Non-limiting examples of the present embodiments are shown in figures wherein:

DETAILED DESCRIPTION

Figure 1:
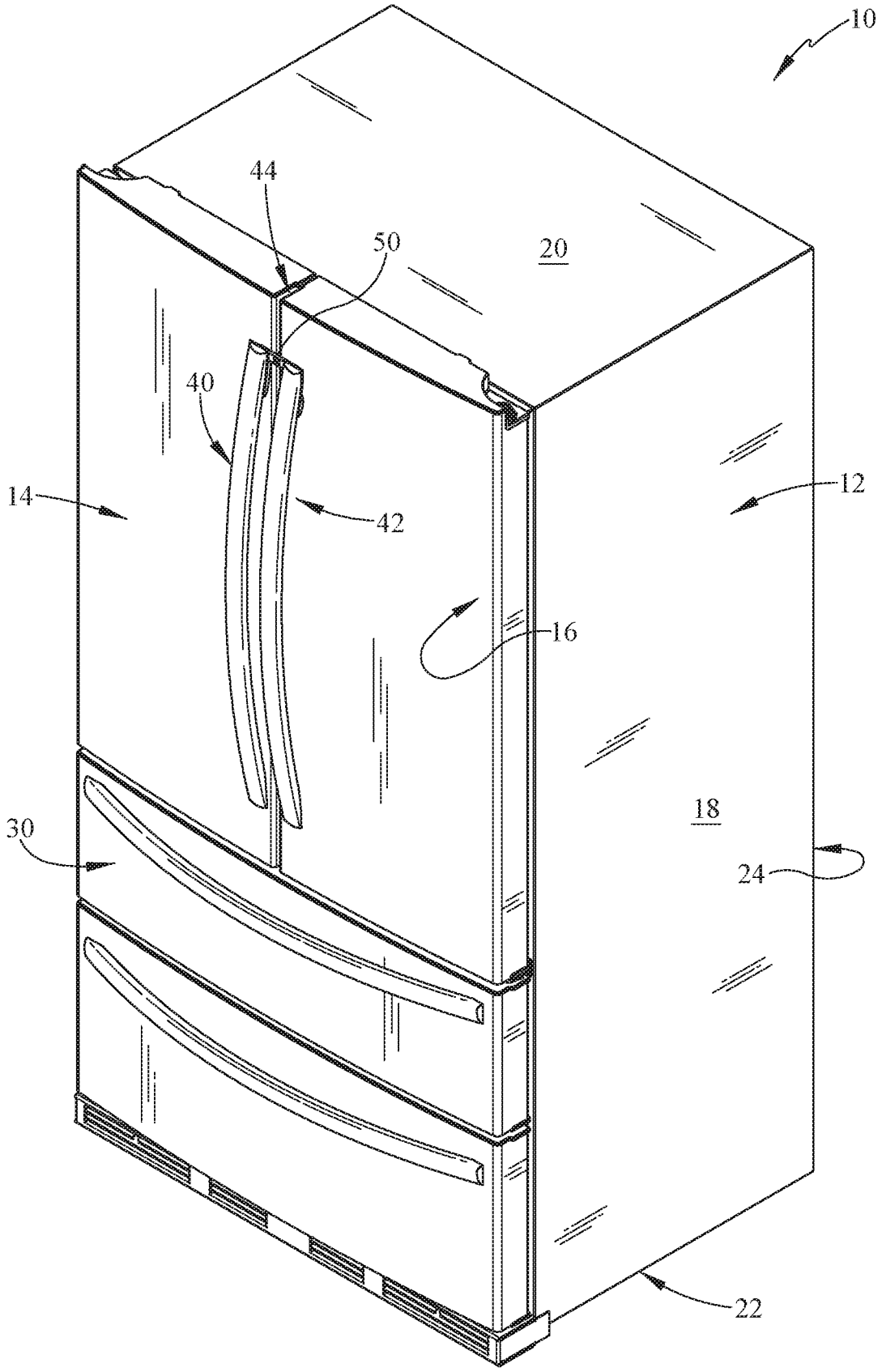
FIG. 1 is a perspective view of an example of an appliance having an appliance lock assembly.

It is to be understood that the appliance lock assembly is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-11B various embodiments related to an appliance lock assembly which allows conversion of a residential or static structure-type appliance having at least one door or drawer to be utilized in a mobile structure, such as a recreational vehicle ("RV"), boat or other mobile environment wherein the at least one door or drawer should be locked to inhibit unintentional opening during mobile operations and scattering of contents from within the appliance.

Referring now to FIG. 1, an appliance 10 is shown which may be designed primarily for residential use but which may be reconfigured for use in a mobile environment. The appliance 10 is shown throughout as a refrigerator. However, one skilled in the art should recognize that multiple appliance types may be utilized or substituted which have either a door or drawer such as ovens, cabinet doors, dishwashers or the like. It is advantageous to provide an assembly lock which may be added to an appliance and require minimal effort to make the conversions desirable for use in a mobile application. For example, it may be desirable to provide a lock assembly which does not need any further drilling and/or cutting of the existing appliance and may be utilized merely by inserting and fastening or otherwise the addition of adhesive, epoxy or the like.

The appliance 10 is, according to some embodiments, a refrigerator and will be referred to throughout this specification. However, one skilled in the art will recognize that other types of refrigerators may be utilized, as well as other types of appliances. The present appliance 10 embodiment includes a housing 12 having at least one door 14 and in one instant embodiment, a second door 16. This is commonly referred to as a French door configuration but other door configurations ay be utilized. The first door and the second door 14, 16 are pivotally connected to the housing 12 to allow access or alternatively, close access to an opening of an interior cabinet. The opening in the refrigerator embodiment provides for access to the cabinet wherein fresh or frozen food may be stored.

The housing 12 may be defined by a plurality of sides 18, a top 20, a bottom 22, and a rear surface 24. On the rear surface 24, or hidden with the rear surface 24, may be numerous components defining a cooling system, described further herein.

Beneath the first and second doors 14, 16 may be at least one drawer 30. The drawers 30 are an optional feature and may be used in addition to the at least one door 14 of the appliance 10, or in some embodiments, there may be no drawers. In alternative embodiments, the at least one drawer 30 may be above or below the at least one door 14. Further, appliance lock assemblies may be provided to inhibit opening and closing of the at least one drawer 30.

The at least one door 14 may also include a handle 40. The at least one handle 40 of the instant embodiment comprises a first handle 40 and a second handle 42. The first and second handles 40, 42 are generally located near a space or gap 44 separating the first door 14 and the second door 16 and extend in a vertical direction adjacent to the gap 44 between the doors 14, 16. In the present embodiment, each door or drawer has a single handle however, other embodiments may be provided wherein each door or drawer has one or more handles.

Extending between the first and second handles 40, 42 is an appliance lock assembly 50. The appliance lock assembly 50 extends across the gap 44 between the doors 14, 16 and inhibits unintentional opening of the doors 14, 16 when the lock 50 is in an actuated, or locked, position. The gap or space 44 may be between two movable features of the appliance 10 or may be defined by a fixed and a movable feature. By extending the appliance lock assembly 50 across the gap or space 44, the movement of at least one door 14, 16 or drawer 30 is inhibited. The appliance lock assembly 50 may extend in a direction which is parallel to movement of the door 14, 16 or drawer 30 or may extend in a direction that is perpendicular to, or at an angle to, the direction of movement.

Figure 2:
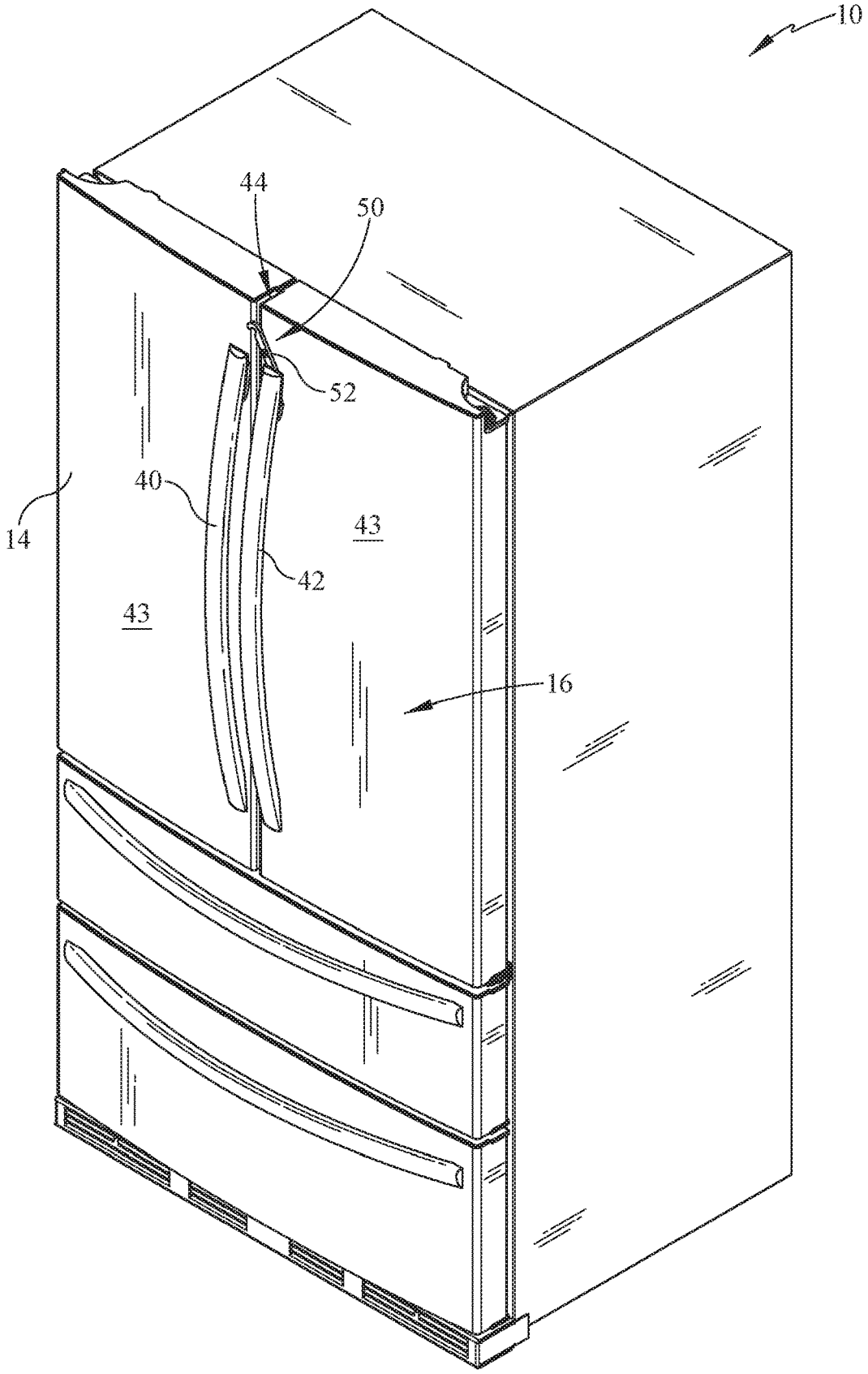
FIG. 2 is a perspective view of the appliance of FIG. 1 with one embodiment of an appliance lock assembly shown in an unlocked position.

Referring now to FIG. 2, the appliance 10 is depicted in a perspective view, again. The appliance 10 is shown in the configuration of FIG. 1 except that the appliance lock assembly 50 is moved from its previous position toward an unlocked position. The assembly lock 50 includes an arm 52 which is moved from the horizontal position depicted in FIG. 1 to a closer to upright position moved to or just past the gap 44 between the first and second doors 14, 16, with the arm 52 rotated or retracted to clear the gap 44 so that the doors 14, 16 may be pivotally opened relatively to the housing 12.

The appliance lock assembly 50 is also shown mounted between the handles 40, 42 and the surfaces 43 of the doors 14, 16. In providing the appliance lock assembly 50, it may be desirable to position the appliance lock assembly 50 between the surfaces 43 of the appliance 10 and the handles 40, 42. This provides two advantages. One, the structure is generally hidden or at least partially hidden from view. Additionally, the positioning of the appliance lock assembly 50 between the handles 40, 42 and the appliance surfaces 43 so that the mounting hardware and/or location of the handles 40, 42 may be utilized to preclude the need for additional cutting or drilling into the appliance 10. Specifically, for example in this embodiment, it is further desirable to eliminate the need to drill additional holes into the doors 14, 16.

Figure 3:
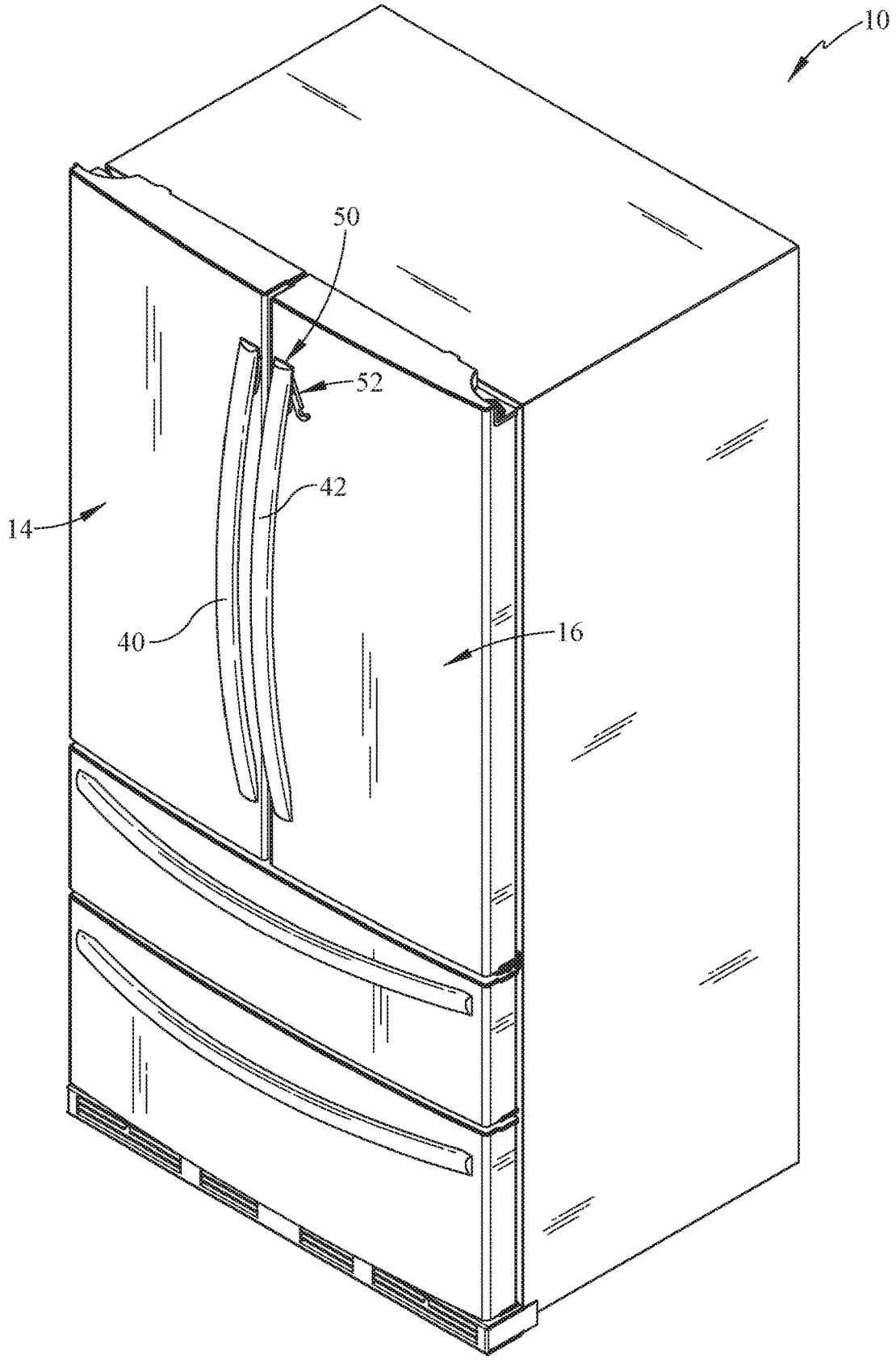
FIG. 3 is a perspective view of the appliance of FIG. 1 with an appliance lock assembly in a different unlocked position than FIG. 2.

With reference now to FIG. 3, the arm 52 is shown further rotated from its position in FIGS. 1 and 2 to a fully unlocked position such that the doors 14, 16 may be opened.

Figure 4:
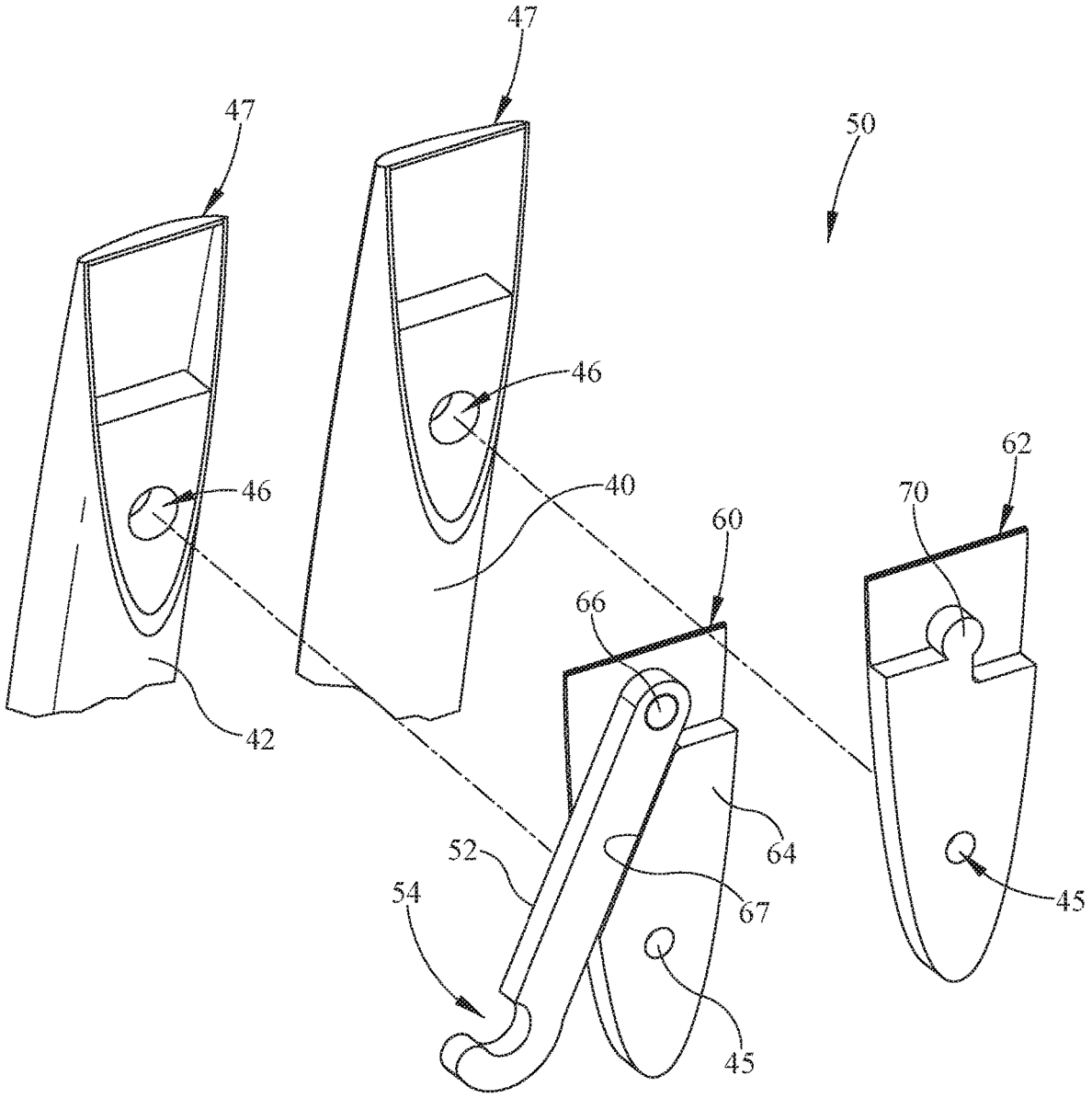
FIG. 4 is a detailed rear perspective and partially exploded view of an appliance lock assembly shown in an unlocked position.

Referring now to FIG. 4, an exploded perspective view of the handles 40, 42 are shown from the lock assembly 50 toward the handles 40, 42. At the tops of the handles 40, 42, the handles 40, 42 have a mounting location 47 wherein mounting hardware, such as a pivot base 60 and a striker base 62 may be located. The mounting locations 47 may differ in shape depending on the handle shape or other hardware utilized. However, the sizing of the mounting location 47 may determine or control the size or shape of the pivot base 60 and the striker base 62 and how the mounting may occur. Each of the bases 60, 62 includes a fastening aperture 45 which when mounted to the handles 40, 42 aligned with holes in the fastening apertures 46 in the handles 40, 42 so that the bases 60, 62 and the handles 40, 42 may be connected to the appliance 10. In this example, the handles 40, 42 are connected to the doors 14, 16 (FIG. 1) respectively.

The pivot base 60 includes a body 64 which extends from the surface of the base 60 and has a thickness which is similar to that of the arm 52. The thickness of body 64 may be slightly greater than the arm 52 so that a slight clearance is created when the pivot base 60 is positioned against the appliance door 14, 16 and so that the arm 52 may pivot without requiring undo effort.

The pivot base 60 also includes a pivot 66 to which the arm 52 is connected. The body 64 may have an edge 67 which aligns with or otherwise supports the arm 52 or otherwise aligns with and may further correspond in shape so that the arm 52 is easily positioned there against and in a desirable position. Adjacent to the handle 40 is the striker base 62.

The arm 52 is shown with a receiver 54 which, according to some embodiments, may be a semi-circular shaped cutout in the arm 52 material. The receiver 54 engages a striker 70 on the striker base 62 and is generally held in position until disengaged by a user. In other embodiments, the arm 52 may have a catch or striker structure which is generally male in configuration, rather than the female configuration of the receiver 54, and the striker base 62 may have the alternate of the male or female configuration part.

The striker base 62 is shown adjacent to the handle 40. The striker base 62 includes a striker 70 which is generally semi-circular in shape and engages the receiver 54 when the arm 52 is rotated toward the striker base 62. The semi-circular shapes of these structures may be alternate shapes which correspond to one another and allow for engagement of the arm 52 and the striker base 62. The striker 70 may be in the form of a male part such as a catch which engages the female receiver 54. However, these configurations may be reversed and such should be considered within the scope of the present embodiments. Further, while the orientation of the male and female parts may change, alternatively the shapes of these parts may further change.

As with the pivot base 60, the striker base 62 also has a fastener aperture 45 which aligns with a fastener aperture 46 in the handle 40. These parts are placed together and then connected to the appliance 10.

It is desirable as previously discussed that the pivot base 60 and the striker base 62 be applicable to the appliance 10 without any additional cutting or drilling of the appliance 10. Accordingly, areas of the bases 60, 62 may be thickened or hardened, or have ribs or other strengthening features so as to provide adequate strength for the handle connection to the doors 14, 16 since this is a location through which loading is applied.

Figure 5:
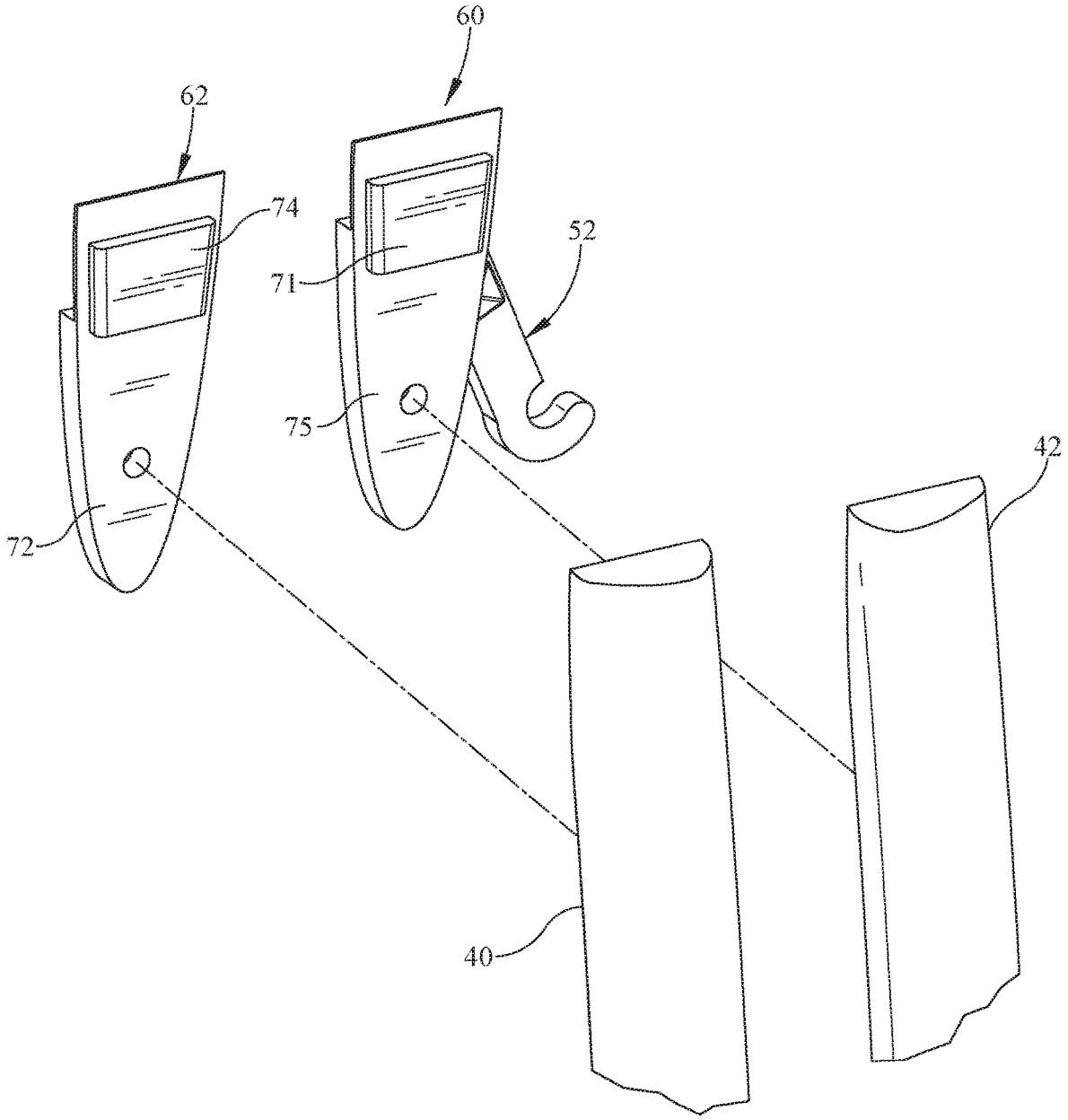
FIG. 5 is a detailed front perspective and partially exploded view of the appliance lock assembly shown in an unlocked position from its previous position of FIG. 4.

Referring now to FIG. 5, the reverse view of that shown in FIG. 4 is depicted. In this view, the handles 40, 42 are shown from a front perspective of the appliance 10, which is removed, and the rear surfaces of the bases 60, 62 are shown.

In this view, the striker base 62 is shown with the rear surface 72 facing the handle 40. On the rear surface 72, an embossment 74 may be provided as a locating feature for the striker base 62 relative to the handle 42. The embossment 74 sits within a recess formed in a mounting location 47 (FIG. 4) of the handle 40. Similarly, the rear surface 75 of the pivot base 60 is shown also with an embossment 71 which functions as a locating feature relative to mounting location 47 (FIG. 4) of handle 42. The arm 52 is also shown in this view partially and is pivoted to an unlocked position. In other embodiments, a male feature may be located on the handle 40, 42 or the appliance surface 43 (FIG. 2) which aligns with a female feature on the bases 60, 62.

Figure 6:
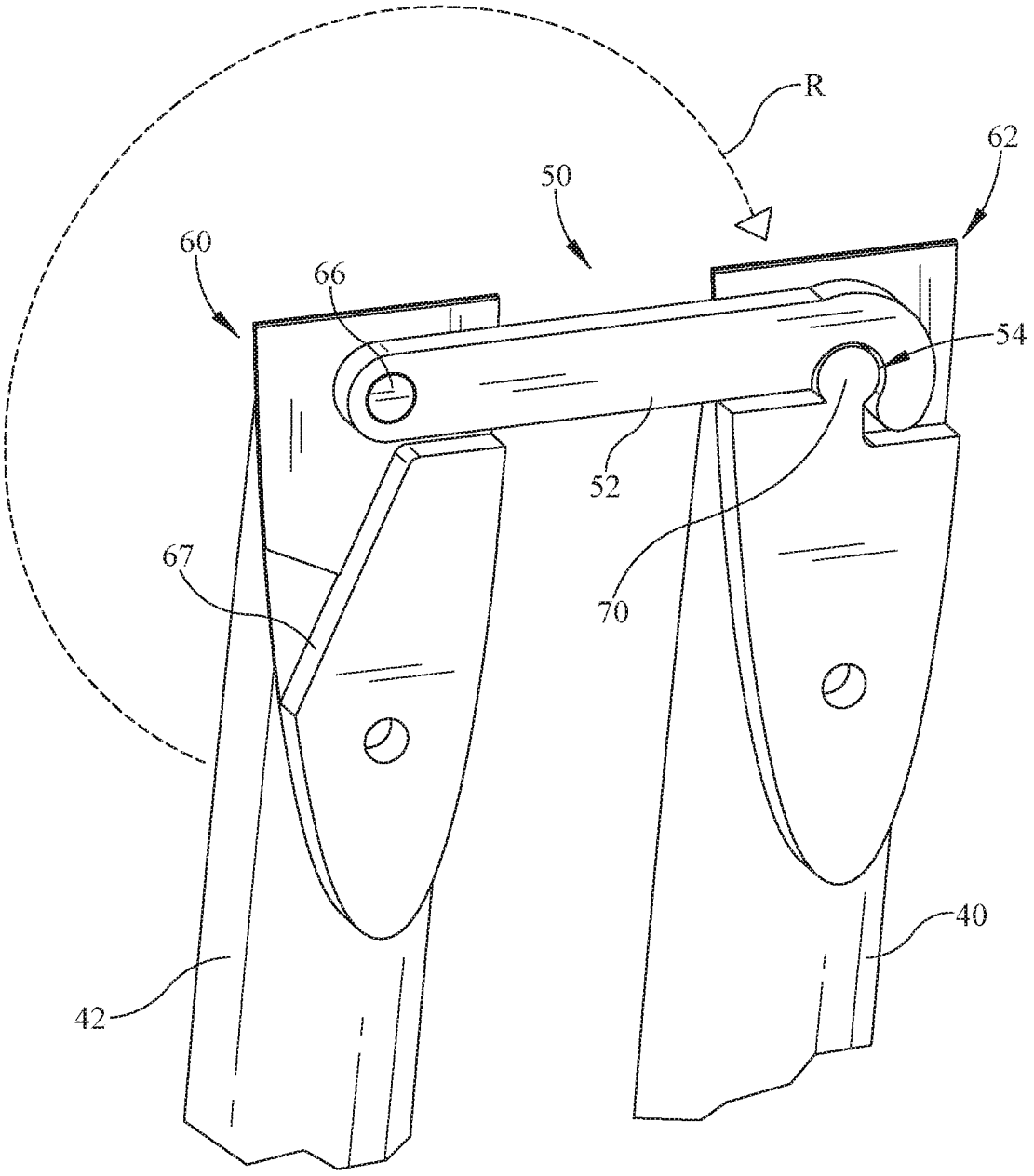
FIG. 6 is a rear assembled perspective view of the appliance lock assembly in a locked position.

Referring now to FIG. 6, a front perspective view of the handles 40, 42 and appliance lock assembly 50 is shown from a rear angle or from the appliance 10 looking rearwardly toward the handles 40, 42. The bases 60, 62 are adjacent to one another defining the appliance lock assembly 50. The arm 52 is shown rotated to a position so that the receiver 54 is engaging the striker 70. In this position, the arm 52 extends across the gap or space 44 (FIG. 1) between the doors 14, 16 (FIG. 1) so that they may not be opened. In order to position the arm 52 as shown, the arm 52 is rotated relative to the pivot 66 in the direction R and away from edge 67, as indicated by the broken line arrow.

Figure 7:
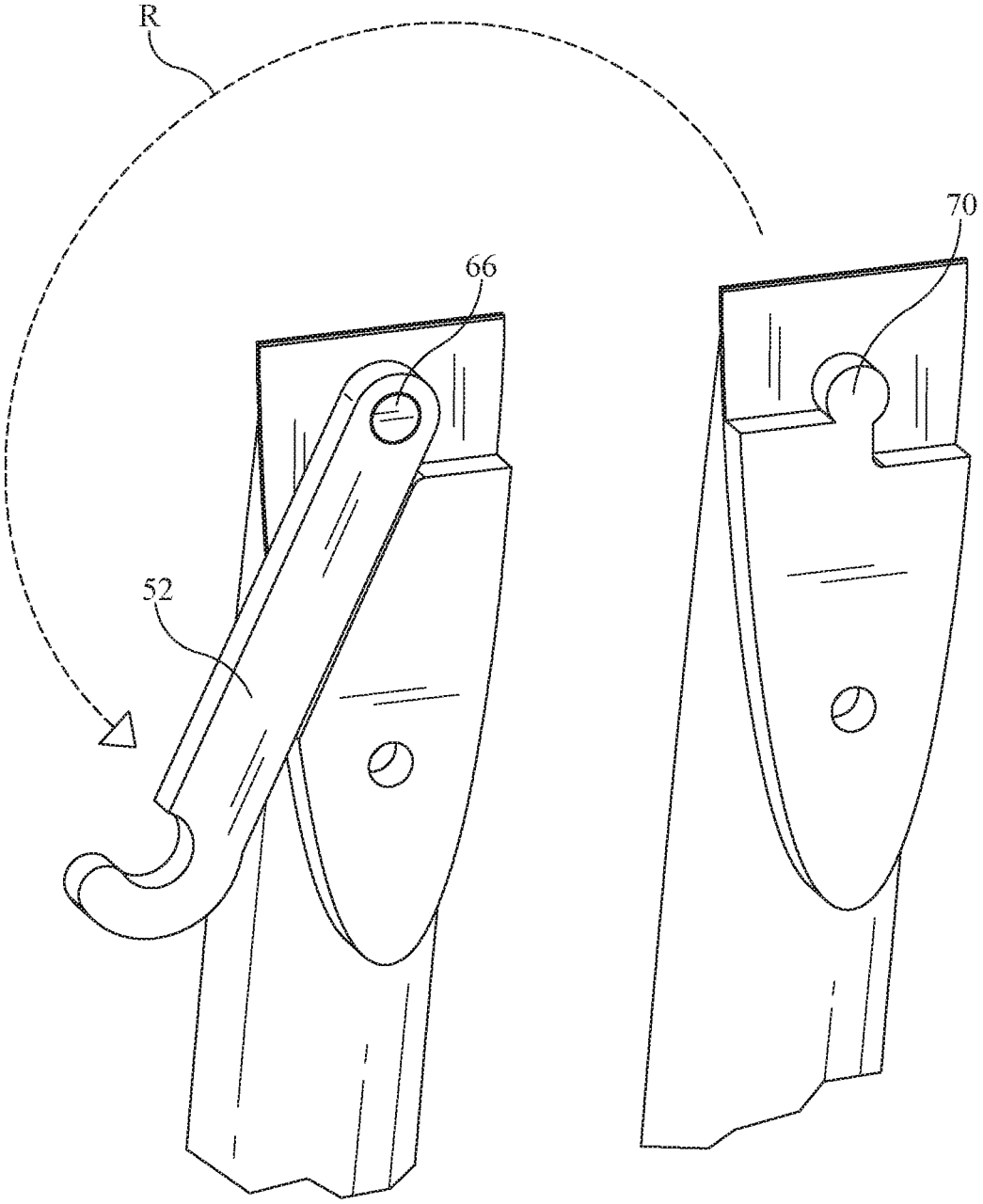
FIG. 7 is a rear assembled perspective view of the appliance lock assembly in an unlocked position.

With reference to FIG. 7, an opposite configuration is shown wherein the arm 52 is rotated away from the striker 70 and the arm 52 is rotated is the direction R depicted. With the pivoting rotation about pivot 66, the arm 52 no longer extends across the gap or space 44 (FIG. 1) between the doors 14, 16 (FIG. 1). Accordingly, the doors 14, 16 may be opened when in this position.

Figure 8B:
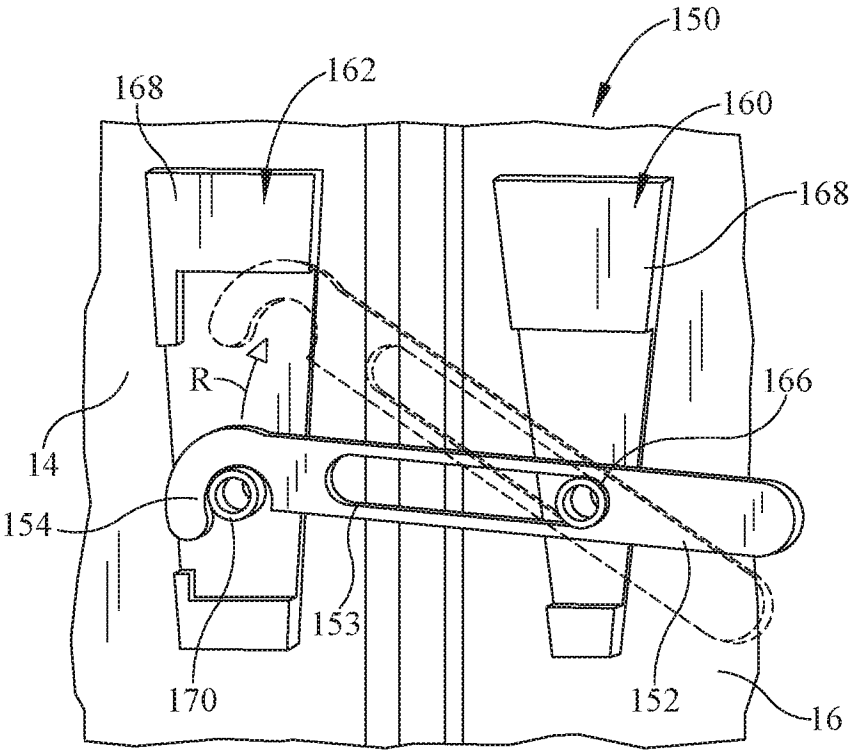
FIGS. 8A and 8B are perspective views of an alternate appliance lock assembly with and without handles.
Figure 8A:
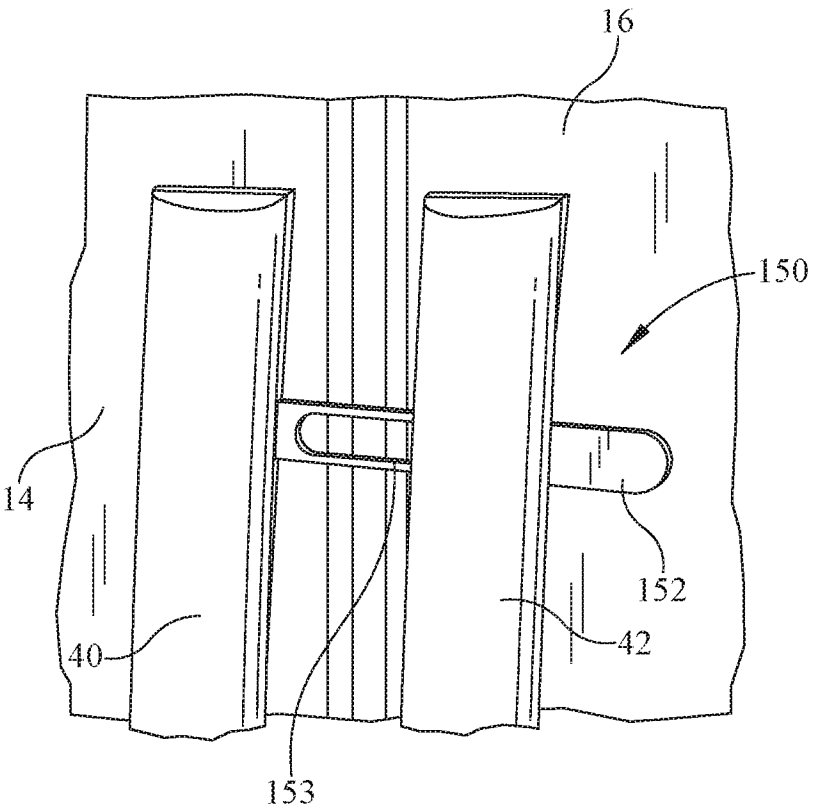

Referring now to FIGS. 8A and 8B, perspective views of alternate appliance lock assemblies are depicted wherein one view includes the appliance handles 40, 42 and the alternate view depicts the assembly with the handles 40, 42 removed. An appliance lock assembly 150 is shown and again is positioned or mounted beneath the handles 40, 42 of the appliance doors 14, 16. The appliance lock assembly 150 again comprises an arm 152 which is pivotable and connected to a base 160. The arm 152 further comprises a slot 153 so that the arm 152 may slide relative to the pivot 166 and is guided by the slot 153. Thus, whereas the previous embodiment operated with a larger rotational range of motion, the instant embodiment utilizes a smaller rotational range but is disengaged with a rotation and a sliding motion of the arm 152 relative to the pivot 166 via the guided movement of the slot 153.

The appliance lock assembly 150 further comprises bases 160, 162 which are connected to existing mounting hardware of the appliance 10. Each base 160, 162 may comprise a mounting key 168 which corresponds to a mounting location 47 (FIG. 4) of the handles 40, 42. Thus, the handles 40, 42 may fit over the mounting keys 168 and the key 168 acts as a locating feature to properly position the handles 40, 42 for subsequent fastening or affixing by other means.

As shown in FIG. 8B, the arm 152 further comprises a receiver 154 which engages a striker 170. When the receiver 154 engages the striker 170, the appliance doors 14, 16 are locked closed. The arm 152 is shown rotated in the direction R and slidably disengaged from the striker 170 in broken line.

Figure 9B:
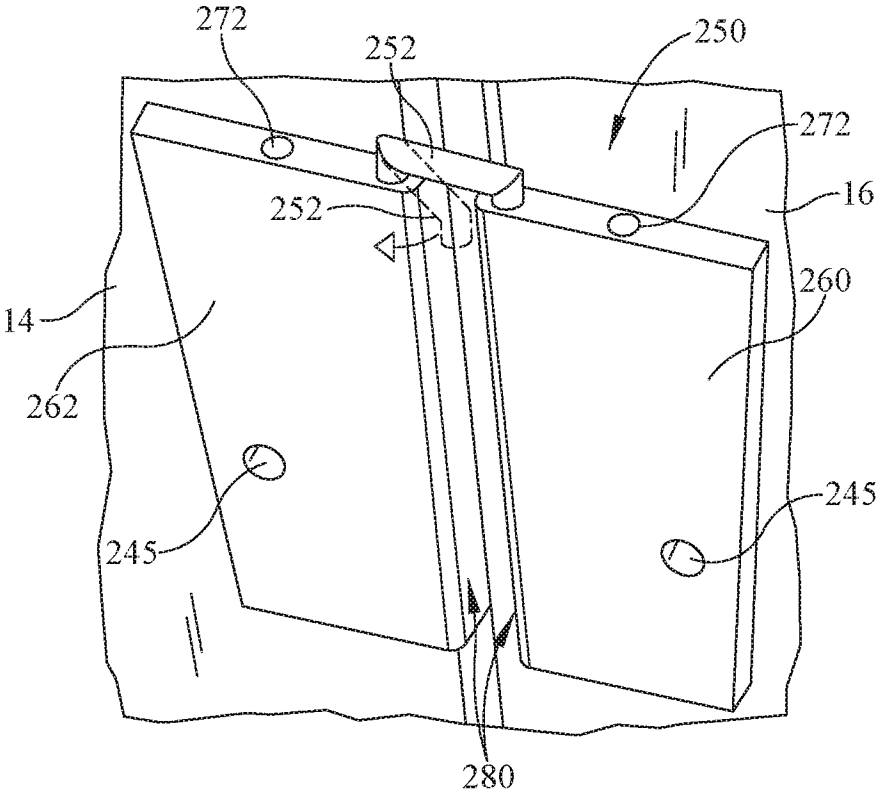
FIGS. 9A and 9B are perspective views of another alternate appliance lock assembly with and without handles.
Figure 9A:
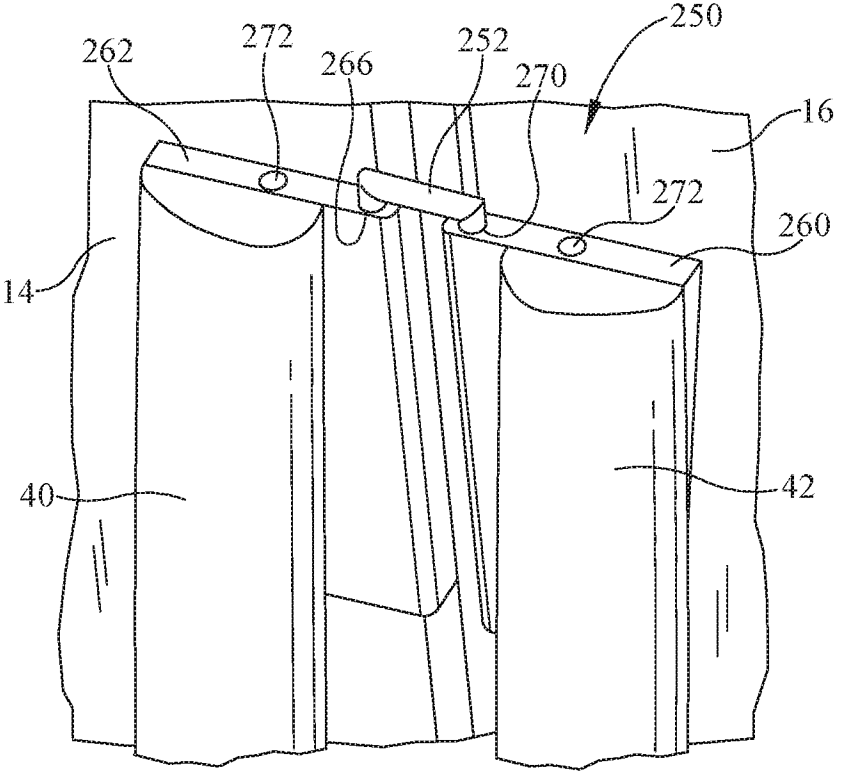

Referring now to FIGS. 9A and 9B, a further alternative embodiment is depicted. The alternate embodiment utilizes an appliance lock assembly 250 having first and second bases 260, 262 and an arm 252 which extends between the bases 260, 262 or may be lifted and pivoted from an engaged position to a disengaged position to unlock the doors 14, 16. The arm 252 is generally U-shaped and is at a first pivot 266 and has an opposite striker 270 which in the instant embodiment, is generally an opening in the base 260. The arm 252, as shown in FIG. 9B, in broken line may be lifted from engagement with the striker 270 and rotated as depicted by broken line to a position in which the arm 252 engages a receiver 272 in the other of the bases 260, 262 adjacent to the pivoting position. Thus, the arm 252 is kept out of the way when the appliance lock assembly 250 is in an unlocked position.

As also shown in FIG. 9B with the handles removed, the bases 260, 262 have mounting hardware 245 which allows easy assembly using existing hardware and apertures of the handles 40, 42. The bases 260, 262 may also have an alignment feature 280, such as an edge or the like which engages the inside edge of the doors 14, 16 to aid in locating and mounting the bases 260, 262 thereon. Various alignment features may be used depending on the shape of the appliance where the bases 260, 262 are located. Further, the features may be protrusions or recesses which cooperated with opposed features on the appliance 10.

Figure 10B:
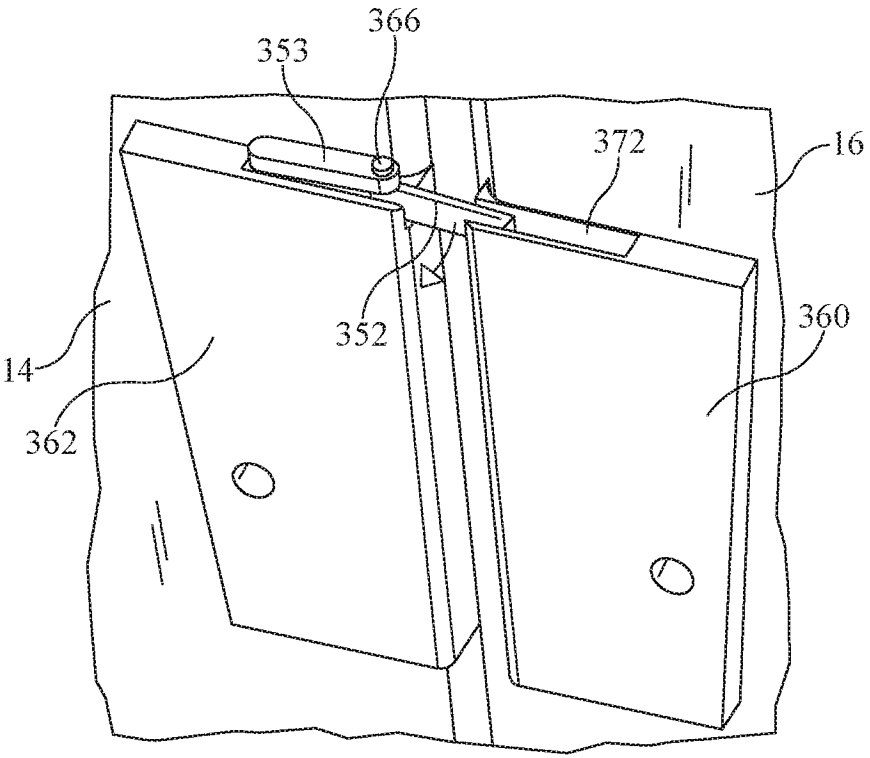
FIGS. 10A and 10B are perspective views of still further appliance lock assembly with and without handles; and, FIGS. 11A and 11B are perspective views of still another appliance lock assembly.
Figure 10A:
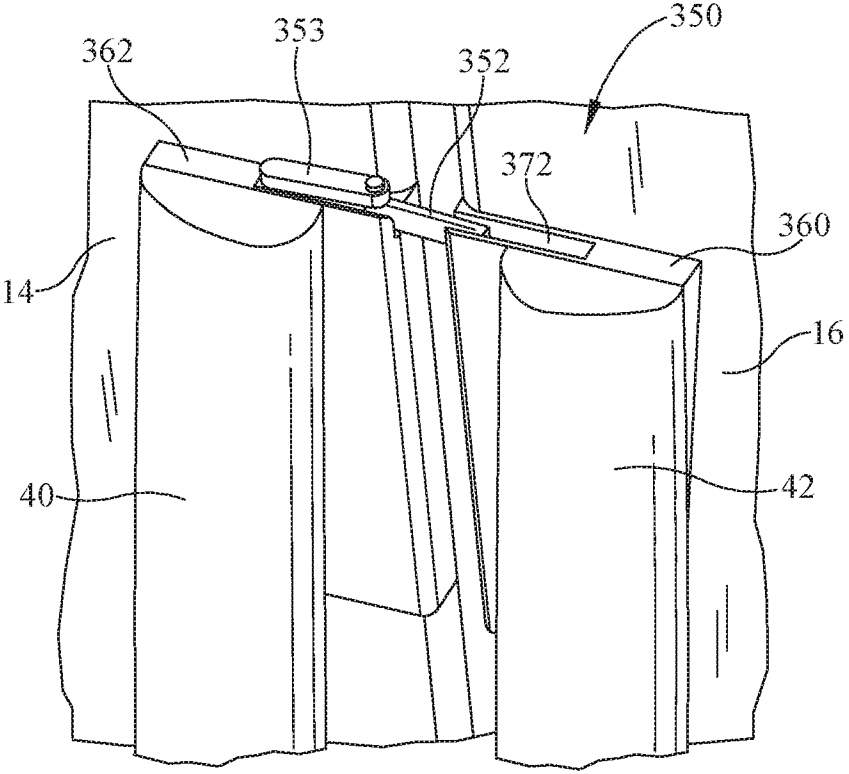

Referring now to FIGS. 10A and 10B, a further alternative embodiment of an appliance lock assembly 350 is depicted. According to the instant embodiment, the appliance lock assembly 350 is positioned between the handles 40, 42 and the surfaces of the doors 14, 16. The appliance lock assembly 350 comprises first and second bases 360, 362 and an arm 352, as with previous embodiments. The instant embodiment comprises a channel 372 located in the upper portion or along an upper edge of the bases 360, 362. The channels 372 provide a flush fit for the arm 352 when the arm is in a locked position. This is in contrast with the embodiment of FIGS. 9A and 9B, which show that the arm 252 is extending substantially above the upper edges of the bases 260, 262. In order to provide a gripping structure for the arm 352, a grasp 353 is provided as well so that the grasp 353 extends slightly or completely above the channel 372 and allows the user a place to lift and pivot the arm 352. The arm 352 can pivot relative to the grasp 353 about pivot 366 when the arm 352 is raised above the channel 372. In order to unlock from the position shown in FIG. 10B, the grasp 353 is used to raised the arm 352 above channel 372 and the arm is pivoted from the position shown to a position under the grasp 353. Likewise, to lock the doors, 14, 16, the grasp 353 is raised and the arm 352 is rotated from beneath the grasp to the position extending across the gap in the doors 14, 16. Then the grasp 353 is released so that the arm 352 is disposed in the channel 372. The embodiment of FIGS. 10A and 10B may also have an alignment feature as described in the previous embodiment.

Figure 11B:
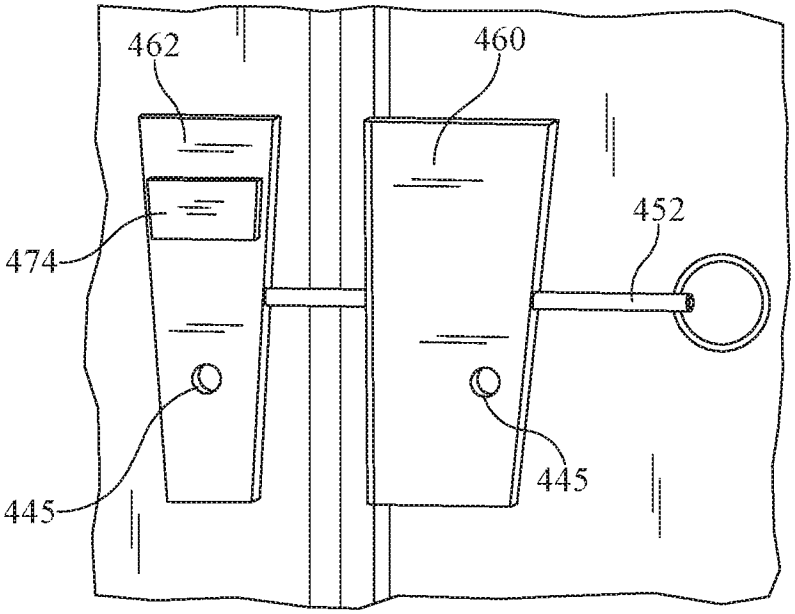
Figure 11A:
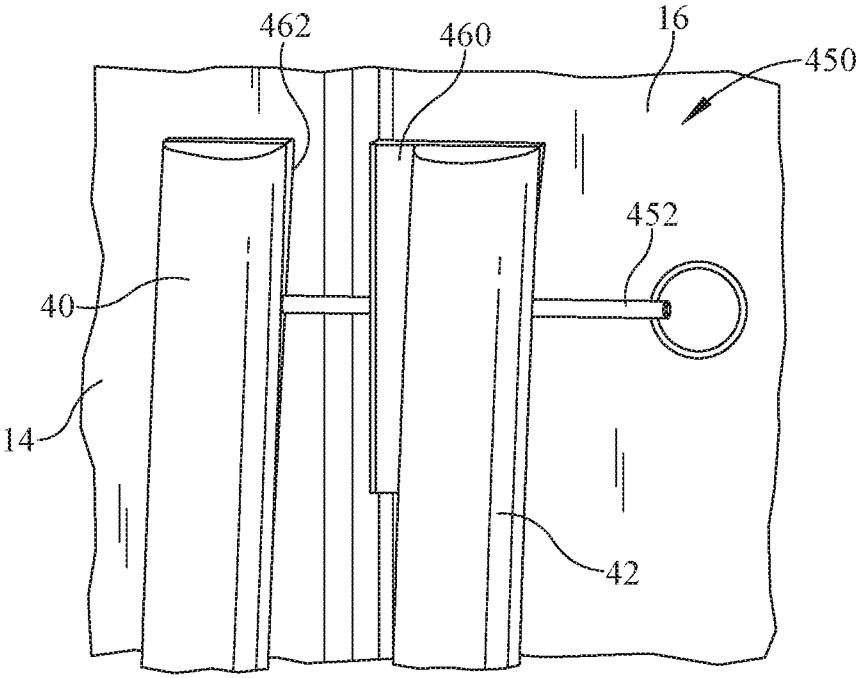

Referring now to FIGS. 11A and 11B, a further embodiment is depicted in front perspective view of an appliance lock assembly 450. In a first embodiment, the appliance doors 14, 16 are shown and the handles 40, 42 corresponding to the doors 14, 16 are shown. Between the doors 14, 16 and the handles 40, 42 are first and second bases 460, 462. The instant embodiment also positions these beneath the handles 40, 42 so as to at least partially hide the structures and each base 460, 462 includes a passage through which an arm 452 extends. According to the instant embodiment, the arm 452, which in this embodiment is a pin, extends through the first base 460 and into a hole or passage in the second base 462. The arm 452 may also include a ring or other grasping member to aid in removing or inserting the arm 452 through the bases 460, 462. As the arm 452 extends across the doors 14, 16, the doors are locked and cannot open until the arm 452 is removed. The arm 452 may be removable from both of the first and second bases 460, 462 or may be biased toward a locked position such that the arm 452 is biased toward the base 462 and needs to be pulled or otherwise actuated each time the doors 14, 16 are opened. For example, the arm 452 may include a spring to bias the arm 452 in one direction.

With reference now to FIG. 11B, the handles 40, 42 are removed and the bases 460, 462 are shown having an embossment 474 which corresponds to a mounting area 47 (FIG. 4) of the handles 40, 42. The bases 460, 462 are formed to fit beneath the handles 40, 42 so as to at least be partially hidden from view. The bases 460, 462 further comprise apertures 445 which align with apertures in the appliance doors 14, 16 for fastening thereof. Thus, additional cutting or drilling is not necessary and the appliance lock assemblies with the function with the existing hardware of the appliance 10.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. An appliance and lock assembly therefore, comprising:

an appliance housing, of said appliance, having at least one opening;

a first door and a second door extending across said at least one opening and being pivotally connected to said appliance housing at opposite sides, said first door and said second door being openable in directions away from one another;

each of said first door and said second door having one of an elongate vertically extending first handle or an elongate vertically extending second handle which is connected to a front surface of said first door or said second door;

a first mounting base and a second mounting base respectively each connected to a rear surface of said first handle and said second handle, said rear surfaces of said first and second handles having one of a recess or an embossment, and said first and second mounting bases each having the other of said recess or said embossment on a surface cooperating with said rear surface, wherein said embossment is received in said recess;

a fastener passing through each of said handle, said mounting base and into said corresponding first or second door;

a pivotable lock arm positioned on one of said first or second mounting bases and extending toward the other of said first or second mounting bases between said first handle and said second handle;

a striker disposed between the other of said first handle or said second handle, and said front surface of the other of said first door or said second door;

wherein said pivotable lock arm is rotatable from a first unlocked position to a second locked position engaging said striker.

2. The appliance and lock assembly of claim 1, said pivotable lock arm having a pivoting connection which is hidden by one of said first handle and said second handle.

3. The appliance and lock assembly of claim 2, said striker being hidden by the other of said first handle and said second handle.

4. The appliance and lock assembly of claim 1, said pivotable lock arm extending across a space between said first door and said second door.

5. The appliance and lock assembly of claim 1, said pivotable lock arm having one of a receiver and a catch.

6. The appliance and lock assembly of claim 5, said striker having the other of said receiver and said catch.

7. The appliance and lock assembly of claim 6, said receiver of a first preselected shape.

8. The appliance and lock assembly of claim 7, said catch having a second preselected shape corresponding to said first preselected shape of said receiver.

9. An appliance lock assembly and appliance combination, comprising:

an appliance housing having at least one opening;

a first door and a second door pivotally connected to said appliance housing for accessing and closing said at least one opening;

said first door and said second door each having an elongate and vertically extending handle to grasp and move each of said first door and said second door, respectively;

a first mounting base disposed beneath one of said handles and a second mounting base disposed beneath the other of said handles;

the first mounting base and the second mounting base respectively each connected to a rear surface of said first handle and said second handle, said rear surfaces of said first and second handles having one of a recess or an embossment, and said first and second mounting bases each having the other of said recess or said embossment on a surface cooperating with said rear surface, wherein said embossment is received in said recess;

a fastener passing through each of said handle, said mounting base and into said corresponding first or second door;

a lock arm engaging one of said first mounting base or said second mounting base and selectively engaging or disengaging a striker of the other of said first mounting base or said second mounting base.

10. The appliance lock assembly of claim 9, said lock arm being pivotally connected to one of said first mounting base or said second mounting base and the lock arm having a receiver.

11. The appliance lock assembly of claim 10, said other of said first mounting base and said first mounting base and said second mounting base having the striker.

12. The appliance lock assembly of claim 10, said lock arm having a slot allowing said pivoting and a sliding motion.

13. The appliance lock assembly of claim 10, said lock arm being disposed in one of said first mounting base and said second mounting base.

* * * * *